US007144104B2

(12) United States Patent
Katayama

(10) Patent No.: US 7,144,104 B2
(45) Date of Patent: Dec. 5, 2006

(54) INKJET RECORDING APPARATUS AND INK CARTRIDGE

(75) Inventor: Naoki Katayama, Kariya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 206 days.

(21) Appl. No.: 10/819,738

(22) Filed: Apr. 7, 2004

(65) Prior Publication Data

US 2004/0201652 A1 Oct. 14, 2004

(30) Foreign Application Priority Data

Apr. 9, 2003 (JP) ..... 2003-104952

(51) Int. Cl.
*B41J 2/175* (2006.01)

(52) U.S. Cl. ..... 347/86; 347/85

(58) Field of Classification Search ..... 347/85, 347/86, 87; 141/2, 18, 19
See application file for complete search history.

(56) References Cited

U.S. PATENT DOCUMENTS 4,558,326 A 12/1985 Kimura et al.
6,030,074 A * 2/2000 Barinaga ..... 347/85
6,074,042 A * 6/2000 Gasvoda et al. ..... 347/50
6,243,115 B1 6/2001 Baker et al.
6,286,949 B1 9/2001 Lewis et al.
6,290,343 B1 * 9/2001 Lewis et al. ..... 347/85
2002/0093556 A1 7/2002 Ishizawa et al.

FOREIGN PATENT DOCUMENTS

EP 0 903 236 A2 3/1999
EP 0 940 258 A1 9/1999
EP 1 203 666 A1 5/2002
JP A-59-59457 4/1984
JP 2003053984 A * 2/2003
WO WO 99/44830 9/1999

* cited by examiner

*Primary Examiner*—Anh T. N. Vo
(74) *Attorney, Agent, or Firm*—Reed Smith LLP

(57) ABSTRACT

An inkjet recording apparatus having a main body, a recording head, and an ink cartridge. The ink cartridge includes: (a-1) an ink reservoir having a spout portion; and (a-2) a case which has a case wall spaced apart from a reservoir wall of the ink reservoir, with a space being formed between the case wall and the reservoir wall. The case has a case opening such that the space is open to an exterior of the case through the case opening. The main body includes: (b-1) a contact member having a recess formed in its contact surface, and held in contact at the contact surface with of the case wall such that the recess is opposed to the case opening and the spout portion; (b-2) a gas supplier for supplying a positively pressurized gas into the recess; and (b-3) an ink drawing member connected to the spout portion so that the ink can be supplied from the ink reservoir toward the recording head through the ink drawing member.

19 Claims, 3 Drawing Sheets

INKJET RECORDING APPARATUS AND INK CARTRIDGE

This application is based on Japanese Patent Application No. 2003-104952 filed in Apr. 9, 2003, the content of which is incorporated hereinto by reference.

BACKGROUND OF THE INVENTION

1. Field of the Invention

The present invention relates to an inkjet recording apparatus and an ink cartridge.

2. Discussion of Related Art

There is known an inkjet recording apparatus which includes: an ink storage in the form of an ink cartridge removably installed in a main body of the apparatus; and a recording head held by the main body and operable to eject an ink, through a plurality of nozzle holes formed in the recording head, onto a recording medium supplied to the apparatus, so that a desired pattern of image is recorded on the recording medium. In such an inkjet recording apparatus, the nozzle holes are easily clogged with impurities such as thicken ink and bubbles generated in an ink passage communicating the ink cartridge and the recording head. There is also known a so-called "purging" operation which is carried out for removing the impurities from the nozzle holes.

There are proposed various methods for achieving the purging operation. For example, U.S. Pat. No. 4,558,326, which is incorporated by reference, in its entirety, or its corresponding JP-A-S59-59457 discloses an inkjet recording apparatus equipped with a purging system in which a cartridge case of an ink cartridge is provided by a rigid member and accommodates a flexible-material-made ink bag in its gas tight space while an air pump is operable to supply a positively pressurized air into the cartridge case so that the ink bag accommodated in the cartridge case is pressed by the positively pressurized air. An ink stored in the bag is forced to be supplied to a recording head under a high positive pressure, whereby impurities clogging the nozzle holes are removed from the nozzle holes.

In this inkjet recording apparatus disclosed in the above-indicated U.S. Patent, described more specifically, the ink cartridge is constructed to includes, in addition to the cartridge case and the ink bag, a spout cap which fluid-tightly plugs an opening of the ink bag and an opening of the cartridge case, and an elastic member which is fitted in a through-hole of the spout cap, for preventing outflow of the ink from the ink cartridge and inflow of a gas from the exterior of the ink cartridge, and also for receiving a hollow needle that is to be pierced through the elastic member. The cartridge case has another opening serving as an air conduction hole through which a positively pressurized air supplied from an air pump is introduced into the cartridge case.

When the ink cartridge constructed as described above is installed on a main body of the inkjet recording apparatus, the hollow needle is pierced through the elastic member, while the air pump is brought into communication with the air conduction hole through an air supply passage. During the recording operation, the ink stored in the ink bag is supplied to the recording head through the hollow needle, without the pressurized air being not supplied from the air pump. During the purging operation, the pressurized air is supplied from the air pump into the cartridge case through the air conduction hole, so that the ink stored in the ink bag is supplied to the recording head under a high positive pressure (see FIGS. 10 and 11 and columns 11–13 of U.S. Pat. No. 4,558,326).

In the inkjet recording apparatus as described above, however, it is necessary to gas-tightly seal not only the connection between the air conduction hole and the air supply passage but also the connection between the spout cap and the cartridge case, for avoiding leakage of the pressurized air from the cartridge case through these connections. Such a sealing arrangement inevitably increases a number of components of the apparatus and a number of steps in a process of manufacturing the apparatus, thereby increasing the cost of manufacture of the apparatus.

Further, since the opening of the cartridge case provided for fixing the spout cap to the cartridge case is gas-tightly sealed, the above-described another opening has to be formed in the cartridge case so as to serve as the air conduction hole. Therefore, an alignment of the air conduction hole with respect to the air supply passage is required in addition to an alignment of the elastic member (press-fitted in the spout cap) with respect to the hollow needle, thereby reducing a degree of freedom in designing the apparatus.

Further, the apparatus suffers from leakage of the ink in a periphery of the hollow needle (i.e., leakage of the ink through connection between the hollow needle and the elastic member), where the elastic member does not have a high degree of elasticity. This ink leakage is caused by a pressure difference between opposite sides of the elastic member. An inside surface of the elastic member (exposed to an interior of the ink bag) is subjected to the ink pressurized by the pressurized air, while an outside surface of the elastic member (exposed to an exterior of the ink bag) is subjected to the atmospheric pressure.

SUMMARY OF THE INVENTION

The present invention was made in view of the background prior art discussed above. It is therefore a first object of the invention to provide an inkjet recording apparatus capable of preventing an ink leakage through connection between an ink cartridge and a main body of the apparatus, with a simplified arrangement for sealing the connection therebetween. It is a second object of the invention to provide an ink cartridge which is advantageously used in the inkjet recording apparatus. The first object may be achieved according to any one of first through third aspects of the invention which are described below. The second object may be achieved according to any one of fourth through seventh aspects of the invention which are described below.

The first aspect of the invention provides an inkjet recording apparatus comprising a main body, a recording head held by the main body, and an ink cartridge removably mounted on the main body, wherein the ink cartridge includes: (a-1) an ink reservoir which has a reservoir wall including a flexible portion provided by a flexible sheet, and which has a spout portion through which an ink reserved in the ink reservoir is supplied to an exterior of the ink reservoir; and (a-2) a case which has a case wall spaced apart from the reservoir wall of the ink reservoir, with a space being formed between the case wall and the reservoir wall, the case having a case opening which is formed through the case wall such that the space is open to an exterior of the case through the case opening, wherein the main body includes: (b-1) a contact member which has a recess formed in a contact surface thereof, and which is to be held in contact at the contact surface with an outside surface of the case wall such that the recess is opposed to the case opening and the spout portion which is positioned in a vicinity of the case opening; (b-2) a pressurized-gas supplier which is operable to supply a positively pressurized gas into the recess; and (b-3) an ink drawing member which is to be connected to the spout portion of the ink reservoir and through which the ink is supplied from the ink reservoir toward the recording head, and wherein the ink drawing member is held by the contact member such that the ink drawing member passes though the recess and is connected to the spout portion of the ink reservoir.

In the present inkjet recording apparatus, with the ink cartridge being mounted on the main body of the apparatus, the case of the ink cartridge being held in close contact, at its wall through which the case opening is formed, with the contact member, while the recess of the contact member is opposed to the case opening and the spout portion which is positioned in the vicinity of the case opening. Therefore, the recess is held in communication with an interior of the case via the case opening, so that the recess and the interior of the case cooperate with each other to constitute a gas-tight space. The ink drawing member held by the contact member passes through the recess and is connected to the spout portion of the ink reservoir, so that the ink reserved in the ink reservoir is supplied to the recording head through the ink drawing member during the recording operation.

In the inkjet recording apparatus constructed as described above, when the positively pressurized gas is supplied from the pressurized-gas supplier into the recess of the contact member, the positively pressurized gas is transmitted to the interior of the case through the case opening, so that the reservoir wall (including the flexible portion) of the ink reservoir is pressed whereby the ink reserved is forced to be supplied toward the recording head under a high pressure. That is, the positively pressurized gas supplied into the recess is transmitted to the interior of the case through the case opening, and then acts on the ink reservoir which includes the spout portion. Therefore, the spout portion dose not have to be sealed with respect to the case, thereby making it possible to eliminate components and manufacturing steps which have been required exclusively for the sealing arrangement, and accordingly to reduce the cost of manufacture of the apparatus.

Further, in the inkjet recording apparatus constructed as described above, an amount of pressure acting on an outside part of the spout portion (which part faces an exterior of the ink reservoir) is substantially the same as an amount of pressure acting on an inside part of the spout portion (which part faces an interior of the ink reservoir). Therefore, the inkjet recording apparatus does not suffer from leakage of the ink in a periphery of the ink drawing member (i.e., leakage of the ink through the connection between the ink drawing member and the spout portion of the ink reservoir), even where the ink drawing member and the spout portion are connected with a relatively small connection strength.

According to the second aspect of the invention, in the inkjet recording apparatus defined in the first aspect of the invention, the recess is surrounded by a non-recessed portion of the contact surface of the contact member, the non-recessed portion being provided by an elastic wall.

In the inkjet recording apparatus according to the second aspect of the invention, the non-recessed portion of the contact surface, at which the contact member is to be held in contact with the case wall, is provided by the elastic wall. Owing to an elasticity of the elastic wall, the contact member can be held in close contact with the case wall. This feature is effective to prevent leakage of the positively pressurized gas (supplied from the pressurized-gas supplier) out of a space defined by the recess and the case wall, thereby making it possible to efficiently carry out the purging operation.

According to the third aspect of the invention, in the inkjet recording apparatus defined in the first or second aspect of the invention, the case opening and the spout portion of the ink reservoir are opposed to each other such that the spout portion is exposed to the exterior of the case through the case opening.

In the inkjet recording apparatus according to the third aspect of the invention, the case opening serves to expose the above-described space, which is formed between the case wall and the reservoir wall, to the exterior of the case, and also serves to expose the spout portion to the exterior of the case. Therefore, the case does not have to have another opening serving exclusively to expose the spout portion to the exterior of the case, unlike in a conventional inkjet recording apparatus. This feature is effective to simplify the construction of the ink cartridge, and also to increase a degree of freedom in designing the apparatus because the requirement as to a positional relationship between the case and the contact member is satisfied by simply aligning the case opening with respect to the recess of the contact member.

The fourth aspect of the invention provides an ink cartridge comprising: (a) an ink reservoir which has a reservoir wall including a flexible portion provided by a flexible sheet, and which has a spout portion through which an ink reserved in the ink reservoir is supplied to an exterior of the ink reservoir; and (b) a case which has a case wall spaced apart from the reservoir wall of the ink reservoir, with a space being formed between the case wall and the reservoir wall, the case having a case opening which is formed through the case wall such that the space is open to an exterior of the case through the case opening, wherein the spout portion of the ink reservoir is positioned relative to the case opening of the case in such a position that permits the spout portion to be exposed to the exterior of the case through the case opening and that permits the space to be held in communication with the exterior of the case through the case opening.

In the present ink cartridge, the case has the case opening which permits the above-described space (formed between the case wall and the reservoir wall) to be open to the exterior of the case through the case opening, and the spout portion of the ink reservoir is positioned relative to the case opening of the case in such a position that permits the spout portion to be exposed to the exterior of the case through the case opening and that permits the space to be held in communication with the exterior of the case through the case opening. This ink cartridge can be advantageously used in the inkjet recording apparatus defined in any one of the first through third aspects of the invention, and can be manufactured easily owing to its simple construction.

According to the fifth aspect of the invention, in the ink cartridge defined in the fourth aspect of the invention, the ink reservoir is provided in the form of a bag having the reservoir wall formed by the flexible sheet, and the bag has a bag opening to which the spout portion is fixed, wherein the case accommodates the ink reservoir so that the space is located within the case, and wherein the case includes an engaging portion which engages or substantially fixes the spout portion of the ink reservoir such that the spout portion is opposed to the case opening.

In the ink cartridge according to the fifth aspect of the invention, the ink reservoir is accommodated in the case, and the spout portion is engaged or substantially fixed by the engaging portion of the case, so as to be opposed to the case opening, while being exposed to the exterior of the case through the case opening.

According to the sixth aspect of the invention, in the ink cartridge defined in the fifth aspect of the invention, the engaging portion of the case protrudes inwardly from an inside surface of the case wall and surrounds the spout portion of the ink reservoir, wherein the engaging portion and the spout portion, which are held in engagement with each other, cooperate with each other to define a clearance therebetween serving as a passage for the communication of the space with the exterior of the case.

In the ink cartridge according to the sixth aspect of the invention in which the engaging portion of the case protrudes inwardly from the inside surface of the case wall and surrounds the spout portion of the ink reservoir, the spout portion can be further reliably engaged or substantially fixed by the engaging portion. Further, since the engaging portion and the spout portion cooperate with each other to define the clearance, the positively pressurized gas supplied from the gas supplier can be introduced into the above-described space (formed between the case wall and the reservoir wall) through the clearance, while the spout portion can be engaged by the engaging portion.

According to the seventh aspect of the invention, in the ink cartridge defined in the sixth aspect of the invention, the clearance serving as the passage includes a first portion located between surfaces of the engaging portion and the spout portion which are opposed to each other in a first direction, and a second portion located between surfaces of the engaging portion and the spout portion which are opposed to each other in a second direction that is different from the first direction, so that the clearance has a labyrinth shape.

In the ink cartridge according to the seventh aspect of the invention in which the clearance is formed to have the labyrinth shape, the spout portion can be further reliably engaged or substantially fixed by the engaging portion which cooperates with the spout portion to define the labyrinth-shaped clearance. Further, the labyrinth shape of the clearance is effective to restrict free flow of the gas through the clearance, thereby maintaining a deaerated condition of the ink reserved in the ink bag, and restraining evaporation of moisture contained in the reserved ink.

BRIEF DESCRIPTION OF THE DRAWINGS

The above and other objects, features, advantages and technical and industrial significance of the present invention will be better understood by reading the following detailed description of presently preferred embodiment of the invention, when considered in connection with the accompanying drawings, in which.

DETAILED DESCRIPTION OF THE PREFERRED EMBODIMENTS

Figure 1:
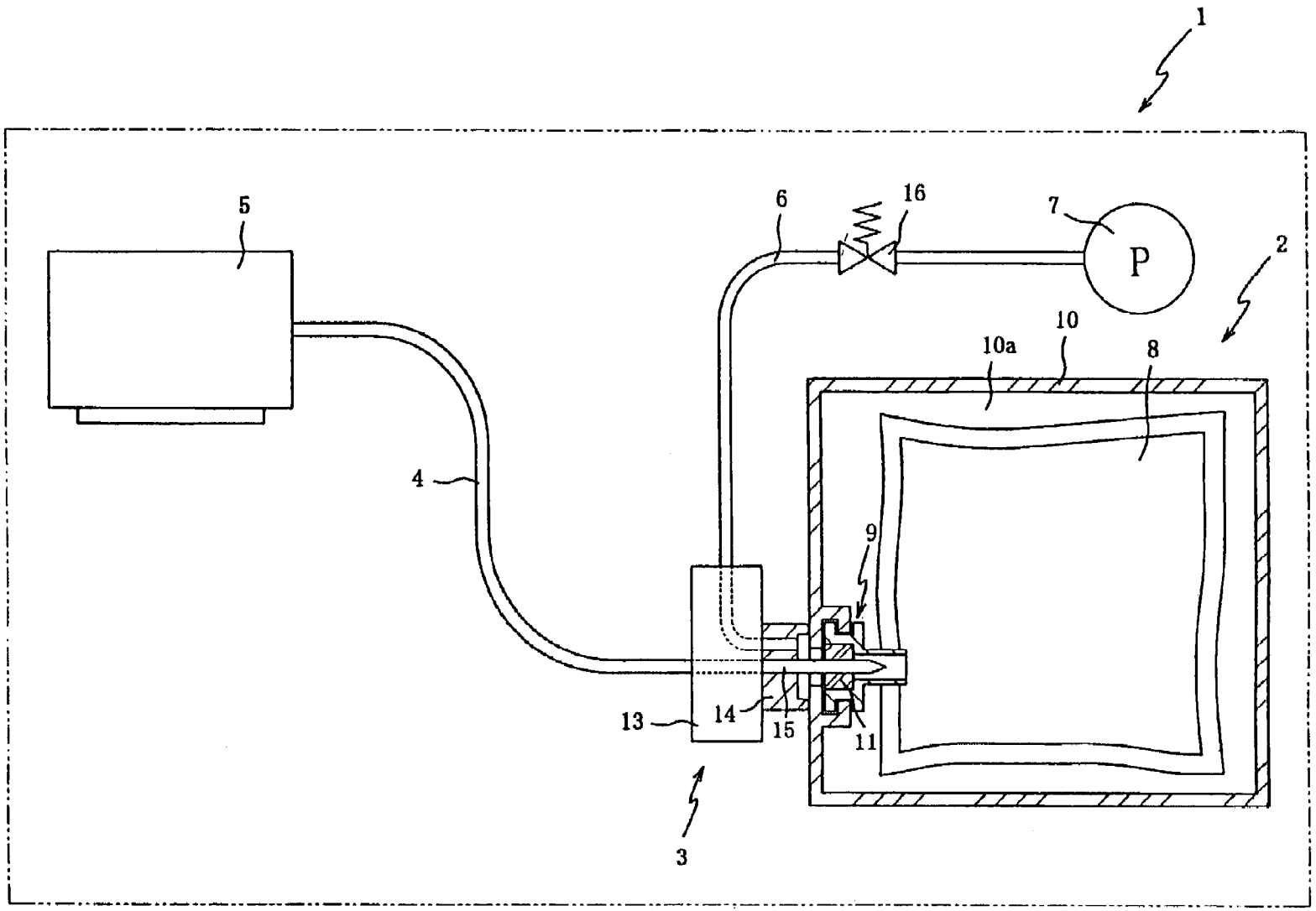
FIG. 1 is a view schematically showing an inkjet recording apparatus constructed according to an embodiment of the invention.
Figure 2:
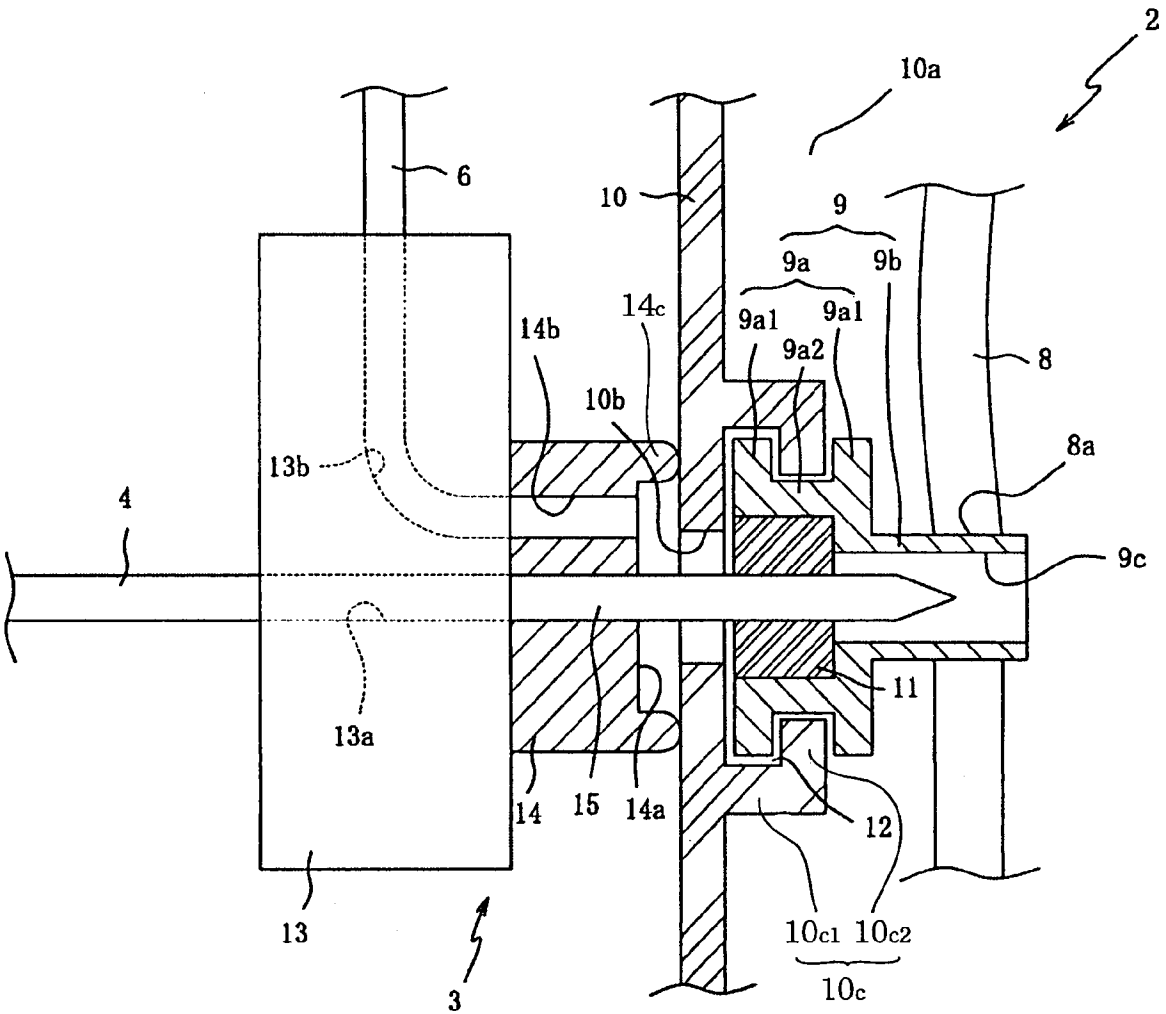
FIG. 2 is a view in enlargement showing an arrangement for connection of an ink cartridge with a main body of the inkjet recording apparatus.

Referring first to FIGS. 1 and 2, there will be described an inkjet recording apparatus 1 constructed according to an embodiment of the invention. FIG. 1 is a view schematically showing the inkjet recording apparatus 1, while FIG. 2 is a view in enlargement showing an arrangement for connection of an ink cartridge 2 with a mount portion 3 of the inkjet recording apparatus 1. In FIG. 2, the ink cartridge 2 and a contact member 14 of the mount portion 3 are represented by their cross sections.

The inkjet recording apparatus 1 is constituted principally by: the ink cartridge 2 serving as an ink storage; the mount portion 3 on which the ink cartridge 2 is removably mounted; a recording head 5 operable to eject an ink onto a recording medium supplied to the recording apparatus 1; an ink supply tube 4 through which the ink is supplied from the ink cartridge 2 to the recording head 5; an air pump 7 operable to supply a positively pressurized air to the ink cartridge 2; and an air supply tube. 6 through which the pressurized air is supplied from the air pump 7 to the ink cartridge 2. It is noted that this recording apparatus 1 is equipped with a central processing unit (not shown) for controlling recording, purging and other operations achieved by the recording apparatus 1.

The ink cartridge 2 includes an ink bag 8 for reserving the ink, a spout cap 9 connected to the bag 8, and an accommodating case 10 accommodating the bag 8 and substantially fixing the spout cap 9 in a predetermined position relative to the case 10. In the present embodiment, the bag 8 and the spout cap 9 cooperate with each other to constitute an ink reservoir. The spout cap 9 corresponds to a spout portion of the ink reservoir.

The bag 8 is provided by two sheets each of which is constituted by a plurality of flexible films laminated on each other. The two sheets are superposed on each other, and are bonded at their respective peripheral portions to each other, for example, by fusing the peripheral portions. The bag 8 has an opening 8*a* which is provided by non-bonded parts of the peripheral portions of the two sheets. The spout cap 9 is fixedly received in this opening 8*a*. Each of the two sheets is constituted by nylon layer (outermost layer), adhesive layer, aluminum alloy layer, adhesive layer, polyethylene terephthalate layer, adhesive layer and polypropylene layer (innermost layer), which are arranged in this order of description.

The laminated structure of each of the sheets enables the bag 8 to have an excellent durability. Further, the bag 8 is given an excellent resistance to the ink stored therein, owing to the polypropylene layer which constitutes the innermost layer of each sheet. Still further, the provision of the aluminum alloy layer as an intermediate layer of each sheet is effective to prevent a gas from permeating through the bag 8, for thereby maintaining a deaerated condition of the ink.

The spout cap 9 is fixed to the opening 8*a* formed through a wall of the bag 8, so that the ink reserved in the bag 8 is supplied to an exterior of the bag 8. The spout cap 9 is provided by a generally stepped cylindrical member which has a large-diameter portion 9*a*, a small-diameter portion 9*b* axially contiguous to the large-diameter portion 9*a*, and a through-hole 9*c* formed therethrough in its axial direction. The small-diameter portion 9*b* is fixed at its outer circumferential surface to an inner circumferential surface of the bag opening 8*a*, for example, by fusing, so that the spout 9 is fixed to the bag 8.

The spout cap 9 is formed of a material whose main component is polypropylene having an excellent resistance to the ink. That is, the main component of the spout cap 9 is identical with a main component of the polypropylene layer which constitutes the innermost layer of the bag 8, so that the spout cap 9 can be firmly fixed to the bag 8. It is therefore possible to restraining or preventing a gas from entering the bag 8 via fixed portions of the bag 8 and the spout cap 9 (i.e., the outer circumferential surface of the small-diameter portion 9*b* and the inner circumferential surface of the bag opening 8*a*), thereby reliably maintaining a deaerated condition of the ink.

The large-diameter portion 9*a* of the spout cap 9 serves as an engaged portion at which the spout cap 9 is engaged with the accommodating case 10 such that the spout cap 9 is substantially fixed in a predetermined position within the accommodating case 10. The large-diameter portion 9*a* has a grooved part $\mathbf{9}a_2$ provided by its axially intermediate part, and maximum-diameter or non-grooved parts $\mathbf{9}a_1$ located on axially opposite sides of the grooved part $\mathbf{9}a_2$. In other words, the large-diameter portion 9*a* has an annular groove and a pair of annular projections $\mathbf{9}a_1$ located on axially opposite sides of the annular groove.

An elastic plug member 11 is provided to be press-fitted in the through-hole 9*c* of the spout cap 9, for isolating the interior of the bag 8 from the exterior of the bag 8. This elastic plug member 11 is made of, for example, butyl rubber or the like. An ink drawing member in the form of a hollow needle 15 is provided to be pierced though the plug member 11, so that the ink can be supplied from the ink bag 8 to the ink supply tube 4. Owing to its elasticity, the plug member 11 forces an outer circumferential surface of the hollow needle 15 in the radially inward direction, for preventing leakage of the ink through a periphery of the hollow needle 15.

The accommodating case 10 is provided by a rigid member, and takes the form of a substantially hollow box defining a gas-tight inner space. Since this gas-tight inner space defined by the accommodating case 10 is larger in size than the ink bag 8, the bag 8 is accommodated within the case 10 with a space 10*a* being formed between the bag wall and the case wall. The case 10 has an opening 10*b* formed through the case wall, and a protrusion 10*c* protruding inwardly from an inside surface of the case wall. The protrusion 10*c* serves as an engaging portion which engages the spout cap 9 such that the spout cap 9 is substantially fixed relative to the case 10 in such a position that permits the spout cap 9 is opposed to the case opening 10*b*. As best shown in FIG. 2, the above-described grooved part $\mathbf{9}a_2$ and one of the non-grooved parts $\mathbf{9}a_1$ (which is located on the side of the case opening 10*b*) of the spout cap 9 are surrounded by the protrusion 10*c* of the case 10.

With the engagement of the case 10 and the spout cap 9 at their engaging and engaged portions 10*c*, 9*a*, the center of the case opening 10*b* is substantially aligned with the center of the spout cap 9. The elastic plug member 11 press-fitted in the spout 9 is exposed to the exterior of the case 10 through the opening 10*b*. It is noted that the spout cap 9 is prevented from passing through the opening 10*b* out of the case 10, since the case opening 10*b* has a diameter that is smaller than a diameter of the maximum-diameter or non-grooved parts $\mathbf{9}a_1$ of the spout cap 9.

The protrusion 10*c* of the case 10, protruding inwardly from the inside surface of the case wall, has a generally annular shape and surrounds the case opening 10*b*. The annular-shaped protrusion 10*c* includes an axially extending portion $\mathbf{10}c_1$ extending in its axial direction and a radially extending portion $\mathbf{10}c_2$ extending in its radially direction inwardly from an distal end of the axially extending portion $\mathbf{10}c_1$. In other words, the protrusion 10*c* of the case 10 includes an annular groove and an annular protrusion $\mathbf{10}c_2$. The radially extending portion (annular protrusion) $\mathbf{10}c_2$ is received in the above-described grooved part $\mathbf{9}a_2$ of the spout cap 9, while the non-grooved parts (annular projection) $\mathbf{9}a_1$ of the spout cap 9 is received in the annular groove of the protrusion 10*c*. As is apparent from FIG. 2, a clearance 12 is formed between the engaging and engaged portions 10*c*, 9*a* which serves as a restricted communication passage for enabling the inner space 10*a* of the case 10 to be held in restricted communication with the exterior of the case 10 via the case opening 10*b*. In the present embodiment, the clearance 12 serving as the communication passage takes the form of a labyrinth shape as a whole, and includes a plurality of bent or curved portions as seen in the cross sectional view of FIG. 2. However, the clearance 12 does not have to necessarily include a plurality of curved portions, as long as the clearance 12 includes at least one curved portion as seen in the cross section view of FIG. 2. That is, the clearance 12 may be formed to include at least one first portion located between surfaces of the respective engaging and engaged portions 10*c*, 9*a* which are opposed to each other in a first direction (e.g. in the axial direction), and at least one second portion located between surfaces of the respective engaging and engaged portions 10*c*, 9*a* which are opposed to each other in a second direction (e.g. in the radial direction).

The mount portion 3 includes: a base member 13 which is fixed to a main body of the recording apparatus 1; a contact member 14 (connecting member) which is fixed to the base member 13 and which is held in contact with the accommodating case 10 of the ink cartridge 2; and the above-described hollow needle 15. It is noted that the mount portion 3 further includes a guide wall (not shown) so that the ink cartridge 2 is slidably moved along this guide wall so as to be mounted on the mount portion 3.

The base member 13 is provided by a rigid member made of a metallic material or synthetic resin. The base member 13 serves to connect the ink supply tube 4, the air supply tube 6 and the ink cartridge 2, and also to hold the contact member 14 and the hollow needle 15. The base member 13 has an ink supply passage 13*a* and a first air supply passage 13*b* in the form of through-holes formed therein. The ink supply passage 13*a* is provided to communicate the ink supply tube 4 with the hollow needle 15. The first air supply passage 13*b* is provided to communicate the air supply tube 6 with a second air supply passage 14*b* that is described below.

The contact member 14 is made of an electric material whose main component is rubber, and has a recess 14*a* formed in its surface opposed to the ink cartridge 2. The recess 14*a* is opposed to the case opening 10*b* and the spout cap 9, and is defined or surrounded by an elastic wall 14*c* which is formed in the above-described surface opposed to the ink cartridge 2 and extends continuously in a circumferential direction of the contact member 14. The contact member 14 further has the above-described second air supply passage 14*b* in the form of a through-hole formed therein. This second air supply passage 14*b* is provided to communicate the first air supply passage 13*b* with the recess 14*a*.

With the ink cartridge 2 being mounted on the mount portion 3, the elastic wall 14*c* of the contact member 14 is held in close contact at its distal end face with the wall of the accommodating case 10, and is being elastically deformed or compressed. The opening 10*b* of the case 10 is positioned within the elastic wall 14*c* of the contact member 14, as seen in a direction parallel with an axis of the case opening 10*b*, so that the recess 14*a* and the case 10 cooperate with each other to define a space that is contiguous to the case opening

10*b*. When the purging operation is effected, positively pressurized air is supplied from the air pump 7 to this space. In this instance, owing to the close contact of the elastic wall 14*a* of the contact member 14 with the wall of the case 10, the supplied air dose not leak out of the space through connection between the contact member 14 and the case 10.

Since the case opening 10*b* is held in communication with the above-described space 10*a* (formed between the walls of the respective bag 8 and case 10) via the clearance 12, the space defined by the case 10 and the recess 14*a* of the contact member 14 is held in communication with the space 10*a* via the case opening 10*b*. That is, the space 10*a* and the space defined by the case 10 and the recess 14*a* cooperate with each other to form a single gas-tight space.

The hollow needle 15, serving as an ink drawing member, is built in the contact member 14 such that the hollow needle 15 passes through the recess 14*a* of the contact member 14 and is opposed to the elastic plug member 11 which is fitted in the through-hole 9*c* of the spout cap 9. The hollow needle 15, thus built in the contact member 14, is held by the base member 13 such that the hollow needle 15 is connected with the ink supply passage 13*a* formed in the base member 13. With the ink cartridge 2 being mounted on the mount portion 3, the hollow needle 15 passes through the case opening 10*b* and is pierced through the elastic plug member 11, so that the ink reserved in the bag 8 is supplied to the recording head 5 through the hollow needle 15 and the ink supply passage 13*a*.

The recording head 5 is provided with a plurality of nozzle holes through which the ink stored in the cartridge 2 is ejected onto the recording medium. The recording head 5 is mounted on a carriage (not shown) which is operable to be reciprocated. The recording head 5 achieves the recording operation while being reciprocated together with the carriage. During the purging operation, the recording head 5 is positioned in a predetermined purging operation position located outside a recording area (within which the recording head 5 is moved for achieving the recording operation), and the ink containing impurities is ejected from the recording head 5 and is received by a waste ink tank (not shown) which is disposed in the purging operation position.

The air pump 7 is activated to supply the positively pressurized air into the accommodating case 10 during the purging operation. In an intermediate portion of the air supply tube 6 which supplies the pressurized air toward the ink cartridge 2, there is disposed a pressure regulator valve 16. During the purging operation, the pressurized air generated by the air pump 7 is supplied into the space 10*a* formed within the accommodating case 10, through the air supply tube 6, the first air supply passage 13*b*, the second air supply passage 14*b*, the recess 14*a*, the case opening 10*b* and the clearance 12. The pressure regulator valve 16 is operated, upon completion of the purging operation, to adjust a pressure in the case 10 such that the pressure (which has been pressurized during the purging operation) is substantially equalized to the atmospheric pressure.

There will be described an operation of the inkjet recording apparatus 1 which is constructed as described above.

The ink cartridge 2 can be mounted onto the mount portion 3, by moving or sliding the ink cartridge 2 along the guide wall (not shown). When the ink cartridge 2 is thus mounted onto the mount portion 3, the contact member 14 is brought into close contact with the accommodating case 10, so that the case opening 10*b* is surrounded by the elastic wall 14*c* of the contact member 14 and is contiguous to the recess 14*a* of the contact member 14. Meanwhile, the hollow needle 15, projecting from a bottom surface of the recess 14*a*, is introduced into the case 10 through the case opening 10*b* and is pierced through the elastic plug member 11. With the ink cartridge 2 being thus mounted on the mount portion 3, the ink reserved in the ink bag 8 is supplied to the recording head 5 through the hollow needle 15, the ink supply passage 13*a* and the ink supply tube 4, the ink is then ejected from the recording head 5 onto the recording medium.

In the purging operation, the recording head 5 is moved to the purging operation position, while the air pump 7 is activated to supply the pressurized air into the recess 14*a* of the contact member 14 through the air supply tube 6, the first air supply passage 13*b* and the second air supply passage 14*b*. The pressurized air supplied into the recess 14*a* is then supplied into the space 10*a* in the case 10, through the case opening 10*b* and the clearance 12, whereby a volume of the flexible-material-made bag 8 accommodated within the case 10 is reduced. The ink stored in the bag 8 is forced out of the bag 8, and is supplied under a high pressure to the recording head 5, passing through the above-described route. Thus, the impurities clogging the nozzle holes are ejected, together with the, ink, from the nozzle holes.

In this instance, a pressure in the space defined by the recess 14*a* and the accommodating case 10 is increased equally with a pressure in the space 10*a* within the case 10, so that the elastic plug member 11 receives, at its outside surface as well as its inside surface, the pressure substantially equal to the pressure applied to the bag 8. Therefore, even if the elastic plug member 11 (forcing an outer circumferential surface of the hollow needle 15) does not have a high degree of elasticity, it is possible to prevent leakage of the ink from the bag 8 through connection between the hollow needle 15 and the elastic plug member 11. When the recording operating is restarted after the purging operation has been completed, the air pump 7 is turned off, and the pressure in the space 10*a* within the case 10 is reduced by the pressure regulator valve 16, to the atmospheric level.

In the inkjet recording apparatus 1 of the present invention, as described above, with the ink cartridge 2 being mounted on the mount portion 3, the case opening 10*b* communicating the inner space 10*a* of the case 10 with the exterior of the case 10 is contiguous to the space defined by the recess 14*a* of the contact member 14, so that the inner space 10*a* of the case 10 is held in communication with the space defined by the recess 14*a* via the case opening 10*b*, whereby the inner space 10*a* of the case 10 and the space defined by the recess 14*a* cooperate with each other to form the single gas-tight space. Therefore, unlike a conventional inkjet recording apparatus, the present recording apparatus 1 is capable of carrying out the purging operation, without the case opening 10*b* being gas-tightly sealed. Thus, it is possible to eliminate components and manufacturing steps which have been required exclusively for gas-tightly isolating the interior of the accommodating case 10 from the exterior, thereby reducing the cost of manufacture of the apparatus.

Figure 3:
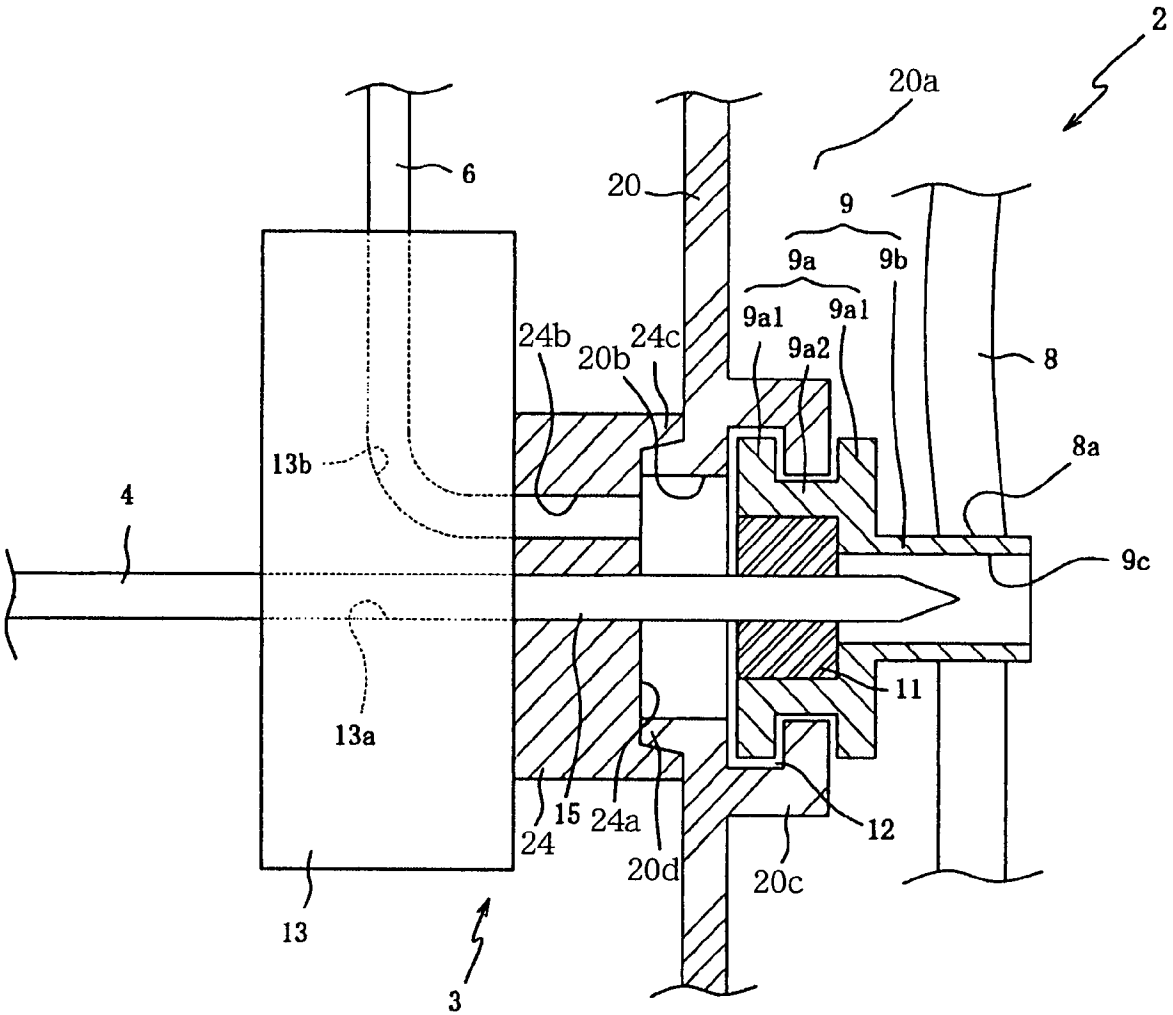
FIG. 3 is a view in enlargement showing another arrangement for connection of the ink cartridge with the main body of the inkjet recording apparatus.

Referring next to FIG. 3, there will be described another arrangement for the connection of the ink cartridge 2 with the mount portion 3. In the following description of this another arrangement, the same reference numeral as used in the above-described arrangement will be used to identify the elements which are the same as or similar to those in the above-described arrangement. No redundant description of these elements will be provided.

In the above-described arrangement, the contact member 14 and the accommodating case 10 are connected to each other by bringing the end face of the contact member 14 into close contact with the wall of the case 10, as best shown in FIG. 2. In this another arrangement of FIG. 3, the accommodating case 10 and the contact member 14 are replaced with an accommodating case 20 and a contact member 24, respectively. The accommodating case 20 has an engaging or fitting boss 20*d* provided on the outside surface of the wall of the case 20. This fitting boss 20*d* is fitted in a recess 24*a* formed in a surface of the contact member 24 which is opposed to the ink cartridge 2, so that the contact member 24 and the case 20 are connected to each other. It is noted that, like FIG. 2, FIG. 3 is a view in enlargement showing parts of the ink cartridge 2 and the mount portion 3 which parts are related to the connection of the contact member and the case.

The fitting boss 20*d*, having an annular shape, surrounds the case opening 20*b* and protrudes toward the recess 24*a* of the contact member 24. The fitting boss 20*d* has an outer circumferential surface which is tapered such that its outside diameter is reduced as viewed in a direction toward the contact member 24 away from the ink bag 8. The case 20 has a protrusion 20*c*, which serves as an engaging portion engaging the spout cap 9, like the protrusion 10*c* in the above-described arrangement. The contact member 24 has an elastic wall 24*c* surrounding the recess 24*a* and having an inner circumferential surface which is tapered such that that its inside diameter is increased as viewed in a direction toward the case 20 away from the base member 13.

With the fitting boss 20*d* of the case 20 being fitted in the recess 24*a* of the contact member 24, the elastic wall 24*c* of the contact member 24 is held in contact at its large surface area with the case 20. The fitting boss 20*d* is forced by the elastic wall 24*c* which is being elastically deformed or compressed. This arrangement provides a higher degree of gas tightness of the space defined by the case and the recess of the contact member, than the above-described arrangement. It is therefore possible to further reduce an amount of air leaking from the space, thereby enabling the inner space 20*a* of the case 20 to be given a desired pressure condition in an early stage. This technical feature leads to reduction in length of time of activation of the air pump 7 and reduction in running cost of the apparatus. Further, since the outer circumferential surface of the fitting boss 20*d* and the inner circumferential surface of the elastic wall 24*c* are provided by respective tapered surfaces, the case 20 and the contact member 24 can be easily held in engagement with each other. It is noted that both of the outer and inner circumferential surfaces of the fitting boss 20*d* and the elastic wall 24*c* do not have to be tapered, as long as at least one of the surfaces is tapered.

In the above-described embodiment, the purging operating is carried out by supplying the pressurized air into the accommodating case 10 or 20 of the ink cartridge 2 through the first air supply passage 13*b*, the second air supply passage 14*b* or 24*b* and the case opening 10*b* or 20*b*, namely, by applying the positive pressure to the ink stored in the ink bag 8 which is accommodated in the case 10 or 20. However, the purging operation may be carried out by applying a vacuum pressure into the nozzle holes (not shown) of the recording head 5, in addition to the application of the positive pressure into the case 10 or 20. The application of the vacuum pressure can be made, for example, in a known manner in which a vacuum pump is provided to generate the vacuum pressure and the generated vacuum pressure is then supplied into a suction cap which is provided to cover the nozzle holes. Where the vacuum pressure as well as the positive pressure is thus used for the purging operation, the positive pressure may be applied to the ink stored in the ink bag 8, only during a short stage (e.g., after the application of the vacuum pressure until removal of the suction cap from the nozzle hole), so that the ink received in the suction cap is prevented from being sucked back into the nozzle holes due to a back pressure which is generated by a head difference between the hollow needle 15 and the nozzle holes of the recording head 5.

The application of the positive pressure to the stored ink is effective not only for cleaning the clogged nozzle holes but also for other purpose. For example, where the ink cartridge 2 is replaced with a new one, it is possible to facilitate introduction of the ink into the recording head 5 from the new ink cartridge 2, by applying the positive pressure to the stored ink.

The labyrinth shape of the clearance 12 is effective to restrict free flow of the air through the clearance 12 where the pressure in the above-described space 10*a* or 20*a* (defined by and between the walls of the respective bag 8 and case 10 or 20) is substantially equal to the atmospheric level. It is therefore possible to prevent a gas from being dissolved into the ink stored in the ink bag 8, thereby maintaining a deaerated condition of the ink and restraining evaporation of moisture contained in the stored ink, even if the bag 8 is made of such a material that can not perfectly prevent a gas or water vapor from permeating through the bag 8.

While the preferred embodiment of the invention has been described in detail by reference to the accompanying drawings, it is to be understood that the invention is not limited to the details of the illustrated embodiment, but may be embodied with various other changes, modifications and improvements, which may occur to those skilled in the art.

What is claimed is:

1. An inkjet recording apparatus comprising a main body, a recording head held by said main body, and an ink cartridge removably mounted on said main body, wherein said ink cartridge includes:

an ink reservoir which has a reservoir wall including a flexible portion provided by a flexible sheet, and which has a spout portion through which an ink reserved in said ink reservoir is supplied to an exterior of said ink reservoir; and a case which has a case wall spaced apart from said reservoir wall of said ink reservoir, with a space being formed between said case wall and said reservoir wall, said case having a case opening which is formed through said case wall such that said space is open to an exterior of said case through said case opening, wherein said main body includes:

a contact member which has a recess formed in a contact surface thereof, and which is to be held in contact at said contact surface with an outside surface of said case wall such that said recess is opposed to said case opening and said spout portion which is positioned in a vicinity of said case opening;

a pressurized-gas supplier which is operable to supply a positively pressurized gas into said recess; and an ink drawing member which is to be connected to said spout portion of said ink reservoir and through which the ink is supplied from said ink reservoir toward said recording head, and wherein said ink drawing member is held by said contact member such that said ink drawing member passes though said recess, and is connected to said spout portion of said ink reservoir.

2. The inkjet recording apparatus according to claim 1, wherein said case accommodates said ink reservoir so that said space is located within said case.

3. The inkjet recording apparatus according to claim 2,
wherein said case includes an engaging portion which engages said spout portion of said ink reservoir such that said spout portion is opposed to said case opening,
wherein said engaging portion of said case protrudes inwardly from an inside surface of said case wall and surrounds said spout portion of said ink reservoir,
and wherein said engaging portion and said spout portion, which are held in engagement with each other, cooperate with each other to define a clearance therebetween serving as a passage for the communication of said space with the exterior of said case.

4. The inkjet recording apparatus according to claim 3, wherein said clearance serving as said passage includes a first portion located between surfaces of said engaging portion and said spout portion which are opposed to each other in a first direction, and a second portion located between surfaces of said engaging portion and said spout portion which are opposed to each other in a second direction that is different from said first direction, so that said clearance has a labyrinth shape.

5. The inkjet recording apparatus according to claim 3,
wherein one of said engaging portion and said spout portion has an annular groove,
and wherein the other of said engaging portion and said spout portion has an annular projection received in said annular groove.

6. The inkjet recording apparatus according to claim 3,
wherein said engaging portion and said spout portion have respective annular grooves and projections,
and wherein the annular projection of said engaging portion is received in the annular groove of said spout portion, while the annular projection of said spout portion is received in the annular groove of said engaging portion.

7. The inkjet recording apparatus according to claim 1, wherein said recess is surrounded by a non-recessed portion of said contact surface of said contact member, said non-recessed portion being provided by an elastic wall.

8. The inkjet recording apparatus according to claim 7, wherein said non-recessed portion of said contact surface of said contact member is provided to surround said case opening.

9. The inkjet recording apparatus according to claim 7, wherein said case further has an annular engaging boss which surrounds said case opening, and which is to be held in engagement at a circumferential surface thereof with a circumferential surface of said non-recessed portion of said contact surface of said contact member.

10. The inkjet recording apparatus according to claim 9, wherein at least one of the circumferential surfaces of said annular engaging boss and said non-recessed portion is tapered.

11. The inkjet recording apparatus according to claim 1, wherein said case opening and said spout portion of said ink reservoir are opposed to each other such that said spout portion is exposed to the exterior of said case through said case opening.

12. The inkjet recording apparatus according to claim 11,
wherein said ink reservoir of said ink cartridge further has an elastic plug member which is fitted in said spout portion and which is exposed to the exterior of said case through said case opening,
and wherein said ink drawing member is provided to be pierced through said elastic plug member.

13. An ink cartridge comprising:
an ink reservoir which has a reservoir wall including a flexible portion provided by a flexible sheet, and which has a spout portion through which an ink reserved in said ink reservoir is supplied to an exterior of said ink reservoir; and
a case which has a case wall spaced apart from said reservoir wall of said ink reservoir, with a space being formed between said case wall and said reservoir wall, said case having a case opening which is formed through said case wall such that said space is open to an exterior of said case through said case opening,
wherein said spout portion of said ink reservoir is positioned relative to said case opening of said case in such a position that permits said spout portion to be exposed to the exterior of said case through said case opening and that permits said space to be held in communication with the exterior of said case through said case opening,
wherein said case includes an engaging portion which engages said spout portion of said ink reservoir such that said spout portion is opposed to said case opening,
and wherein said engaging portion and said spout portion, which are held in engagement with each other, cooperate with each other to define a clearance therebetween serving as a passage for the communication of said space with the exterior of said case.

14. The ink cartridge according to claim 13,
wherein said ink reservoir is provided in the form of a bag having said reservoir wall formed by said flexible sheet, and said bag has a bag opening to which said spout portion is fixed,
and wherein said case accommodates said ink reservoir so that said space is located within said case.

15. The ink cartridge according to claim 14,
wherein said engaging portion of said case protrudes inwardly from an inside surface of said case wall and surrounds said spout portion of said ink reservoir.

16. The ink cartridge according to claim 15, wherein said clearance serving as said passage includes a first portion located between surfaces of said engaging portion and said spout portion which are opposed to each other in a first direction, and a second portion located between surfaces of said engaging portion and said spout portion which are opposed to each other in a second direction that is different from said first direction, so that said clearance has a labyrinth shape.

17. The ink cartridge according to claim 15,
wherein one of said engaging portion and said spout portion has an annular groove,
and wherein the other of said engaging portion and said spout portion has an annular projection received in said annular groove.

18. The ink cartridge according to claim 15,
wherein said engaging portion and said spout portion have respective annular grooves and projections,
and wherein the annular projection of said engaging portion is received in the annular groove of said spout portion, while the annular projection of said spout portion is received in the annular groove of said engaging portion.

19. An inkjet recording apparatus comprising a main body, a recording head held by said main body, and the ink cartridge defined in claim 13 and removably mounted on said main body.

* * * * *